US006842941B2

(12) United States Patent
Lee

(10) Patent No.: US 6,842,941 B2
(45) Date of Patent: Jan. 18, 2005

(54) SUCTION PORT ASSEMBLY OF VACUUM CLEANER

(75) Inventor: Byung-jo Lee, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 10 days.

(21) Appl. No.: 09/950,169

(22) Filed: Sep. 10, 2001

(65) Prior Publication Data

US 2002/0050021 A1 May 2, 2002

(30) Foreign Application Priority Data

Oct. 31, 2000 (KR) ..... 2000-64310
Oct. 31, 2000 (KR) ..... 2000-64418
Mar. 20, 2001 (KR) ..... 2001-14433

(51) Int. Cl.[7] ..... A47L 9/04
(52) U.S. Cl. ..... 15/385; 15/325; 15/391; 15/419
(58) Field of Search ..... 15/325, 385, 391, 15/419, 383

(56) References Cited

U.S. PATENT DOCUMENTS

| | | | | | |
|---|---|---|---|---|---|
| 1,821,394 | A | | 9/1931 | Moschetto | 15/98 |
| 2,648,090 | A | * | 8/1953 | Howard | 15/325 |
| 3,122,769 | A | * | 3/1964 | Doersam | 15/325 |
| 3,639,939 | A | * | 2/1972 | Crener et al. | 15/385 |
| 3,719,966 | A | * | 3/1973 | Lamont | 15/385 |
| RE28,022 | E | * | 5/1974 | Lamont | 15/385 |
| 4,485,519 | A | * | 12/1984 | Collier | 15/385 |
| 4,631,775 | A | * | 12/1986 | Palmer et al. | 15/385 |
| 4,939,811 | A | * | 7/1990 | Matunaga et al. | 15/385 |
| 5,615,437 | A | * | 4/1997 | Takahashi et al. | 15/385 |
| 5,974,626 | A | * | 11/1999 | Wood et al. | 15/385 |
| 6,240,596 | B1 | * | 6/2001 | Kiern | 15/385 |
| 6,494,772 | B1 | * | 12/2002 | Barnes et al. | 15/385 |

FOREIGN PATENT DOCUMENTS

| | | |
|---|---|---|
| DE | St 8069 | 12/1956 |
| DE | 1 823 021 U | 12/1960 |
| DE | 1 821 823 U | 10/1963 |
| DE | 1 943 044 U | 7/1966 |
| DE | 72 24 296 U | 6/1972 |
| DE | 26 02 969 A1 | 7/1977 |
| DE | 34 03 800 A1 | 8/1985 |
| DE | 197 18 497 A1 | 11/1998 |
| EP | 0 504 443 A1 | 9/1992 |
| EP | 0 576 174 A1 | 12/1993 |
| EP | 0 590 690 A2 | 4/1994 |
| EP | 1 138 243 A2 | 10/2001 |
| GB | 2 154 128 A | 9/1985 |
| GB | 2 266 230 A | 10/1993 |
| JP | 47-10365 | 10/1947 |
| JP | 11-47047 | 2/1999 |
| JP | 11-225922 | 8/1999 |
| JP | 20001-218852 | 6/2004 |

* cited by examiner

*Primary Examiner*—Theresa T. Snider
(74) *Attorney, Agent, or Firm*—Westman, Champlin & Kelly, P.A.

(57) ABSTRACT

A suction port assembly of a vacuum cleaner. The suction port assembly has a pair of suction paths formed at a front and a rear portions of a bottom of a suction port body, respectively, so as to enhance the cleaning efficiency, and due to a presence of an elastic member formed at a front edge of the suction port body as shock-buffer, the reduction of the durability incurred by the collision with an external obstacle is prevented. Meanwhile, in case that a floorcloth is rotatably disposed on a lower surface of the bottom of the suction port body, since the suction port assembly further includes a floorcloth cover protruding from the bottom of the suction port body toward a cleaning surface, the safety of a user is guaranteed.

5 Claims, 6 Drawing Sheets

SUCTION PORT ASSEMBLY OF VACUUM CLEANER

The present application is based on and claims the benefit of Korean patent application Serial Nos. 2000-64310; 2000-64418; and 2001-14433, filed Oct. 31, 2000; Oct. 31, 2000; and Mar. 20, 2001, respectively, the contents of which are hereby incorporated by reference in their entirety.

BACKGROUND OF THE INVENTION

1. Field of the Invention

The present invention relates to a vacuum cleaner, more particularly, to a suction port assembly of a vacuum cleaner for drawing in air containing dust and foreign substances while moving along a cleaning surface.

2. Description of the Related Art

A vacuum cleaner such as an up-right type or a canister type generally comprises a suction port assembly which connects to a cleaner body and moves along a cleaning surface. The cleaner body comprises a dust collecting chamber in which a dust filter is detachably installed, and a fan motor driving chamber in which a fan motor is installed for providing a suction force. In the above construction, when the fan motor is driven, a strong suction force is generated at a suction port of the suction port assembly. Air containing dust and dirt on the cleaning surface is drawn into the cleaner body by the suction force. The air that is drawn in is discharged out through the dust filter installed in the dust collecting chamber of the cleaner body. While the dirt entrained in the air is filtered out at the dust filter, the air is discharged out through the fan motor driving chamber.

However, when a user moves the suction port assembly along the cleaning surface, there may be a collision between the suction port assembly and obstacles such as furniture or a door sill. Since the collision causes damage or defect to the suction port assembly, the user has to handle the cleaner with care, and the user can not move the suction port assembly as he/she wishes.

Meanwhile, the suction port assembly has a floorcloth disposed rotatably thereon, facing the cleaning surface for wiping foreign substances and a stain off from the cleaning surface. However, the problem is that an edge of the floorcloth is exposed to an external side of the suction port assembly when the floorcloth is rotated at high speed by a driving means. Accordingly, a device is needed for the safety of the user from the floorcloth rotating at high speed.

The suction port assembly has generally a suction path inclusive of the suction port formed at a front bottom of the suction port assembly which faces the cleaning surface. Dirt from the cleaning surface is drawn in through the suction path. The user moves the suction port assembly forward and backward for cleaning. When the user moves the suction port assembly forward, foreign substances or dust is drawn in through the suction path disposed at the front of the suction port assembly. However, when the user moves the suction port assembly backward, dirt at the rear is not drawn in until it reaches the suction path disposed at the front portion of suction port assembly.

Further, in the case that the suction port assembly has the floorcloth disposed on the bottom thereof, facing the cleaning surface, when the suction port assembly moves forward, the rotation of the floorcloth is not interfered. However, when the suction port assembly moves backward, the rotation of the floorcloth is interfered by the foreign substances or dust lodged in the floorcloth.

SUMMARY OF THE INVENTION

The present invention has been made to solve the problems as described above, and accordingly, it is the first object of the present invention to provide a suction port assembly of a vacuum cleaner having an improved construction to buffer the shock to a suction port body.

The second object of the present invention is to provide a suction port assembly of a vacuum cleaner that enhances the cleaning efficiency by improving the construction of an air suction path.

The third object of the present invention is to provide a suction port assembly of a vacuum cleaner having an improved construction that guarantees the safety of a user from a rotating floorcloth.

In order to achieve the first object, the suction port assembly of the vacuum cleaner according to the present invention includes a suction port body connected to a cleaner body through an extension hose, and the suction port body having a suction port for drawing in air containing dust or foreign substances from a cleaning surface therethrough, and shock-buffering means for reducing a shock when the suction port body collides with an obstacle while moving along the cleaning surface.

Here, the shock-buffering means includes an elastic member encompassing an edge of the suction port body, preferably, a front edge of the suction port body opposite to a rear side of the suction port body that is joined with the extension hose.

Meanwhile, in order to achieve the second object, the suction port assembly of the vacuum cleaner according to the present invention comprising a suction port body connected to a cleaner body through an extension hose, the suction port body having a suction port for drawing in the air containing dust and foreign substances from the cleaning surface therethrough, includes a first suction path formed at a front portion of the bottom of the suction port body, through which the air containing dust is drawn in, and a second suction path formed at the rear portion of the bottom of the suction port body, through which the air containing dust is drawn in.

It is desirable that the suction port assembly further includes a guide path formed between the first and the second suction paths for guiding the air drawn in through the first and second suction path to be discharged out through the extension hose.

Moreover, when a floorcloth is rotatably disposed on the bottom of the suction port body, and a rotary driving section is installed inside the suction port body for rotating the floorcloth, it is more desirable that the first and the second suction paths are formed at the front and rear portion of the bottom of the suction port with respect to the rotary driving section, respectively.

Finally, in order to achieve the third object, the suction port assembly of the vacuum cleaner according to the present invention including a suction port body having a suction port for drawing in the air containing dust and foreign substances from the cleaning surface therethrough by a suction force generated when a fan motor of the cleaner body is driven, and a floorcloth rotatably disposed on the bottom of the suction port body, adjacent to the suction port, for wiping foreign substances that is stuck to the cleaning surface, includes a floorcloth cover formed in the suction port body for covering a side edge of the floorcloth so as to prevent the side edge of the floorcloth contacted with the cleaning surface from being exposed from the suction port body.

Desirably, the floorcloth cover comprises a floorcloth cap extended from the bottom of the suction port body for covering the top of the floorcloth facing with the bottom of the suction port body, having a circular arc shaped edge corresponding to the profile of the side edge of the floorcloth, and a fence extended from the circular arc shaped edge toward the cleaning surface for covering the side edge of the floorcloth.

BRIEF DESCRIPTION OF THE DRAWINGS

The object and characteristics of the present invention will be more apparent by describing the preferred embodiments of the present invention with reference to the accompanied reference drawings, in which.

DETAILED DESCRIPTION OF THE PREFERRED EMBODIMENTS

Figure 1:
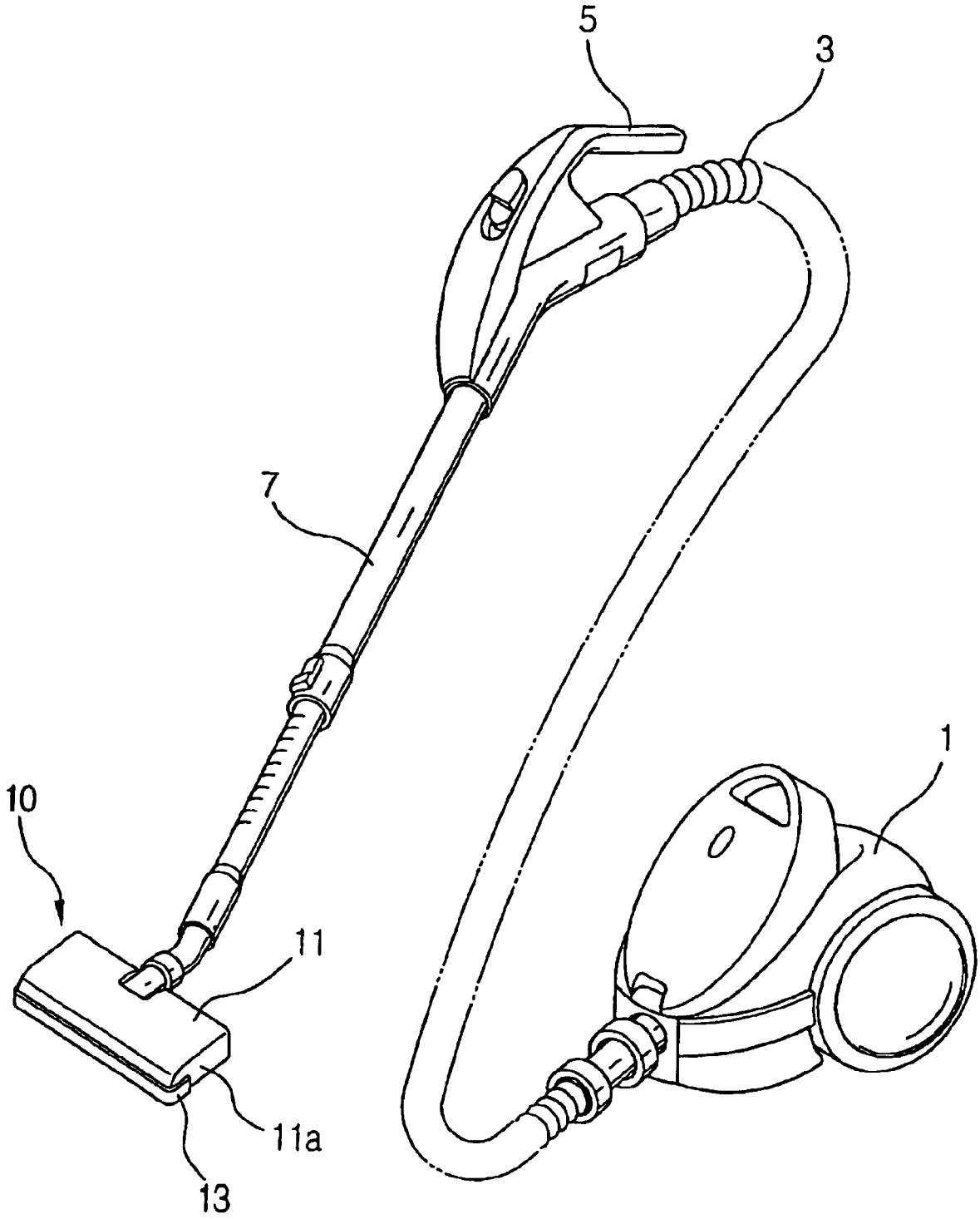
FIG. 1 is a perspective view showing a vacuum cleaner employing a suction port assembly according to a first embodiment of the present invention.

A suction port assembly of a vacuum cleaner according to the embodiments of the present invention is described below with reference to the accompanied reference drawings. FIG. 1 is a schematic perspective view showing a vacuum cleaner employing a suction port assembly according to the first embodiment of the present invention. Referring to FIG. 1, the vacuum cleaner comprises a cleaner body 1, a connecting hose 3 which connects the cleaner body 1 to one end of an extension hose 7, and a suction port assembly 10 movably installed at the other end of the extension hose 7. A handle 5 having an operation switch formed thereon is provided at the extension hose 7. When a fan motor (not shown) mounted in the cleaner body 1 is driven by manipulating the operation switch, it generates a strong suction force at the suction port assembly 10.

The suction port assembly 10 comprises a suction port body 11 and shock-buffering means for reducing shock when the suction port body 11 collides with an obstacle. A suction port (not shown) is formed at a bottom of the suction port body 11 for drawing in air and dust and foreign substances from a cleaning surface therethrough.

The shock-buffering means includes an elastic member 13 mounted on the suction port body 11. The elastic member 13 is made of rubber of a predetermined thickness. Preferably, the elastic member 13 encompasses an edge 11*a* of the suction port body 11 in consideration of frequent collision of the edge 11*a* with obstacles. More preferably, the elastic member 13 encompasses a front edge opposite to a rear edge of the suction port body 11 joined with the extension hose 7. The elastic member 13 may be attached to the edge 11*a* by, an adhesive such as a bond. Alternatively, the elastic member 13 may be mounted on the suction port body 11 by a screw or a hook.

As described above, even though the suction port assembly 10 collides with an obstacle such as furniture or wall during the cleaning, the entire shock of the collision does not reach to the suction port body 11 due to the presence of the elastic member 13. Accordingly, the suction port body 11 is prevented from damage or defect. Especially, in the case that electric or electronic components (not shown) are built in the suction port body 11, the components are effectively prevented from the external shock, and the safety and the durability of the cleaner are accordingly enhanced.

Figure 2:
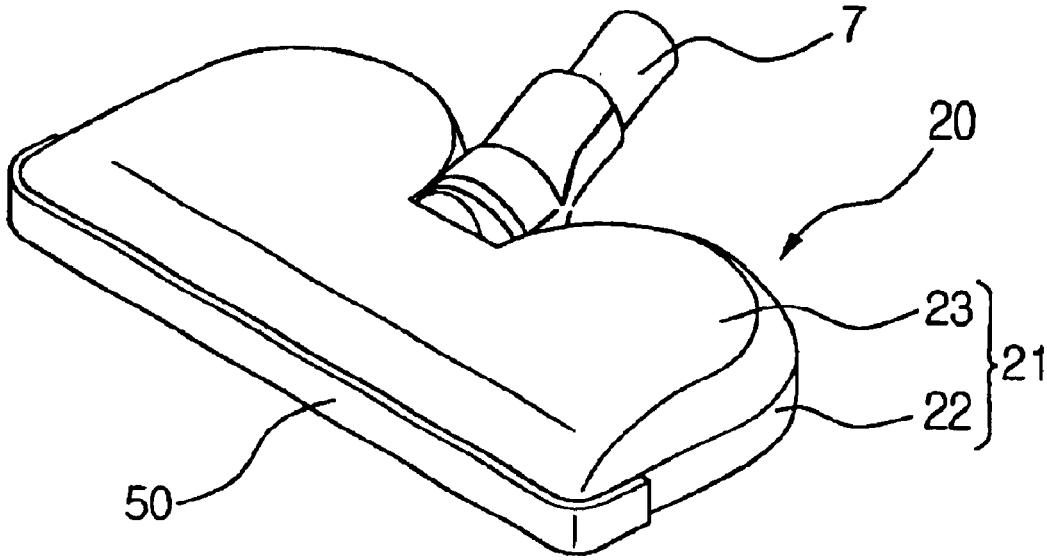
FIG. 2 is a perspective view showing a suction port assembly of a vacuum cleaner according to a second embodiment of the present invention.
Figure 3:
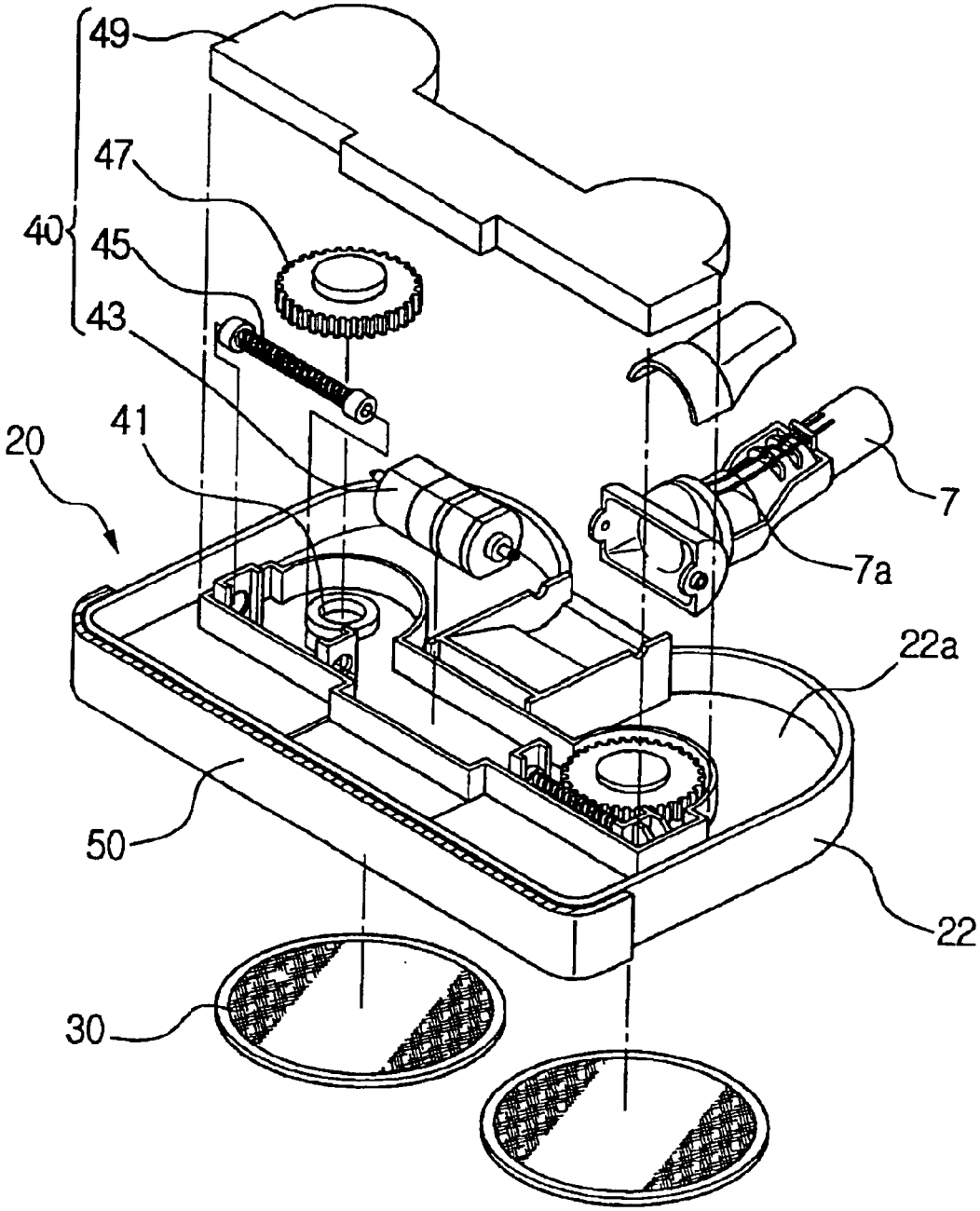
FIG. 3 is a schematic exploded perspective view showing the suction port assembly of FIG. 2.
Figure 4:
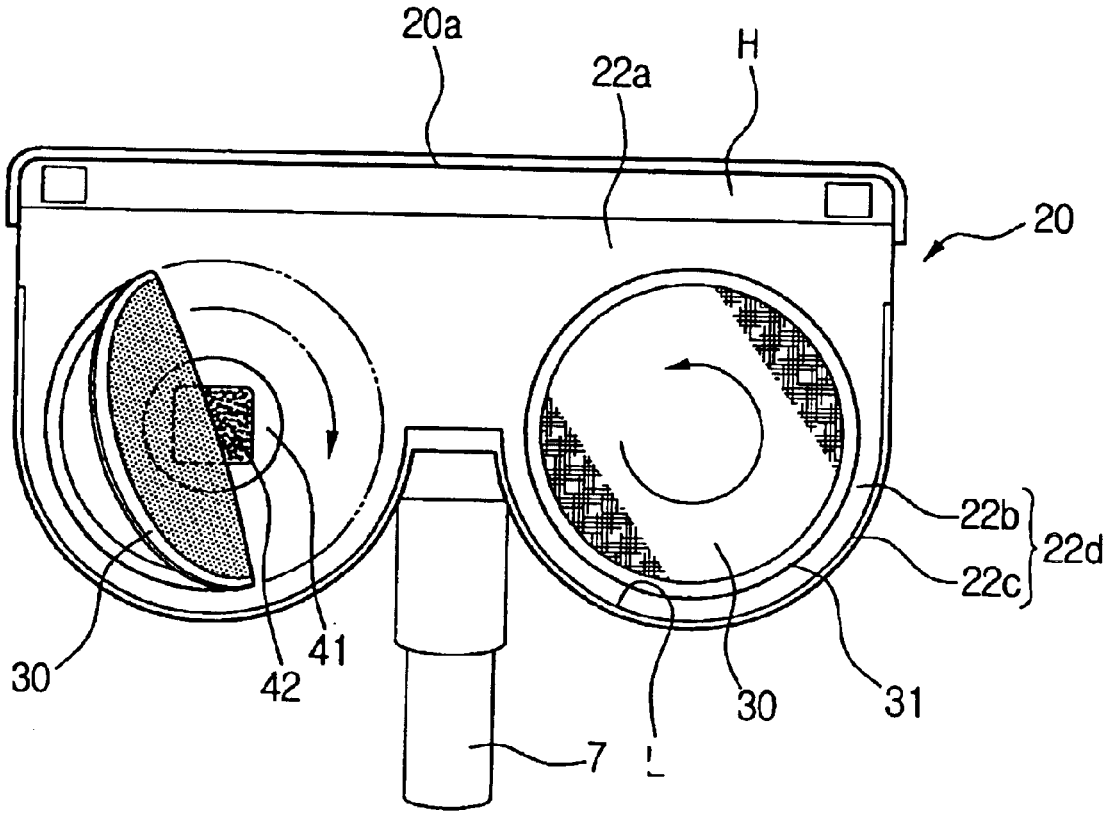
FIG. 4 is a bottom view showing the suction port assembly of FIG. 2.

Referring to FIGS. 2 through 4, a suction port assembly 20 of a vacuum cleaner according to the second embodiment of the present invention comprises a suction port body 21 connected to a cleaner body (not shown) through extension hose 7, a floorcloth 30 rotatably disposed on the suction port body 21, and shock-buffering means.

As shown in FIG. 2, the suction port body 21 comprises a base 22 and a cap 23. The floorcloth 30 is rotatably disposed on a bottom 22*a* of the base 22 and exposed to be in contact with the cleaning surface. Here, the floorcloth 30 is removably supported by a rotating element 41 which is rotatably installed in the suction port body 21. The floorcloth 30 has a shape of a disc, and is attached to the rotating element 41 by a Velcro fastener 42. Further, a rotary driving section 40 is provided in the suction port assembly 20 for driving the rotating element 41. The rotary driving section 40 includes a bi-directional rotating motor 43 installed in the suction port body 21, a worm wheel gear 45 and a converting gear 47 for transmitting a driving force to the rotating element 41 from the bi-directional rotating motor 43, a cover 49 for covering the bi-directional rotating motor 43, the worm wheel gear 45, and the converting gear 47. The bi-directional rotating motor 43 connects electrically with an operation switch formed on the handle 5 (shown in FIG. 1) of the extension hose 7 via an electric wire 7*a* built in the extension hose 7. Accordingly, the bi-directional rotating motor 43 is driven by manipulating the operation switch. The driving force generated by driving the bi-directional rotating motor 43 is transmitted to the worm wheel gear 45 and the converting gear 47 which is engaged with the worm wheel gear 45. Accordingly, the rotating element 41 connected with the converting gear 47 rotates at high speed, and thus the floorcloth 30 rotates simultaneously. Here, the bi-directional rotating motor 43, the worm wheel gear 45, and the converting gear 47 are closed off the air drawn into the suction port body 21 by the cover 49 so that the air and dirt drawn into the cleaner body 1 can not flow into the rotary driving section 40. Also, since the rotary driving section 40 is exposed by removing the cover 49, the maintenance and repair thereof can be easily accomplished.

The floorcloth 30 rotates at high speed and wipes foreign substances that are stuck to the cleaning surface. As shown in FIG. 4, when the suction port H and the floorcloth 30, which are disposed on a lower surface of the bottom 22*a* of the suction port body 21, are contacted with the cleaning surface for cleaning the cleaning surface, at this time, if a side edge 31 of the floorcloth 30 is externally exposed during the cleaning, there is a problem in that the floorcloth 30 rotating at high speed collides with a user's foot, furniture or the like. Accordingly, a floorcloth cover 22*d* is provided to the suction port body 21 for covering the side edge 31 of the floorcloth 30 that is exposed. The floorcloth cover 22*d* comprises a floorcloth cap 22*b* extended from the bottom 22*a* for covering a top of the floorcloth 30, and a fence 22*c* extended from the floorcloth cap 22*b* toward the cleaning surface for covering the side edge 31 of the floorcloth 30. The floorcloth cap 22*b* is integrally formed with the bottom 22*a*, and has a circular arc shaped edge L corresponding to the profile of the side edge 31 of the floorcloth 30. The fence 22*c* protrudes from the circular arc shaped edge L toward the cleaning surface. The floorcloth cover 22*d* constructed as described above forms a rear edge opposite to a front edge 20*a* of the suction port body 21. The fence 22*c* also prevents foreign substances wiped by the floorcloth 30 from popping out of the suction port body 21. It means that foreign substances are guided into the suction port H by the fence 22*c* while flowing by the rotating force of the floorcloth 30. Accordingly, the floorcloth cover 22*d* serves to prevent the floorcloth 30 from being exposed, and to enhance the cleaning efficiency by guiding foreign substances into the suction port H.

The shock-buffering means comprises an elastic member 50 disposed on the suction port body 21. The elastic member 50 is made of rubber that is elastically deformable. The elastic member 50 protects the suction port body 21 from shock generated due to collision of the suction port body 21 with an obstacle such as furniture, wall, or a door sill while the suction port body 21 is moved along the cleaning surface. Accordingly, it is desirable that the elastic member 50 is disposed on the front edge 20*a* of the suction port body 21.

Figure 5:
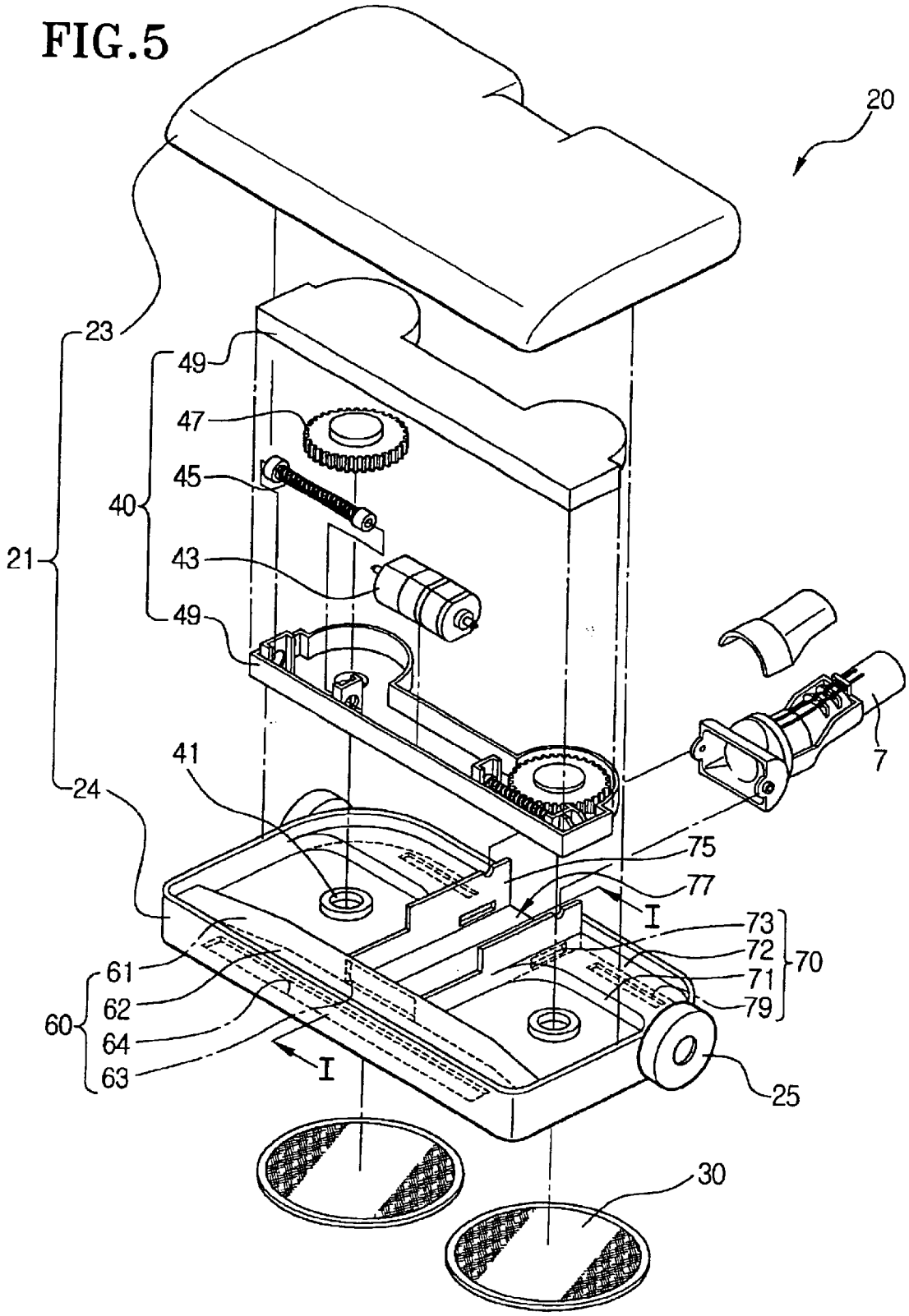
FIG. 5 is an exploded perspective view showing a suction port assembly according to a third embodiment of the present invention.
Figure 6:
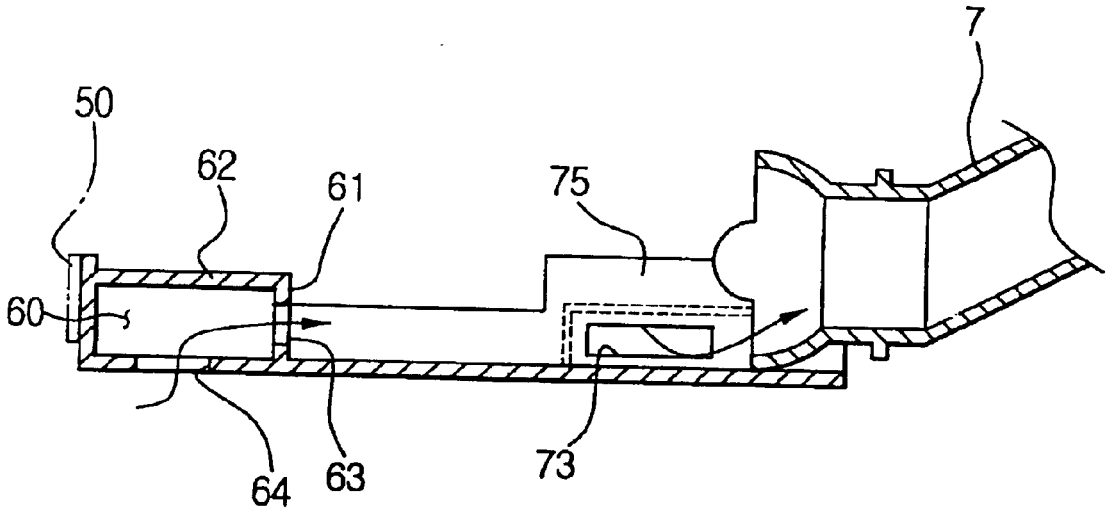
FIG. 6 is a section view taken on line I—I of FIG. 5.
Figure 7:
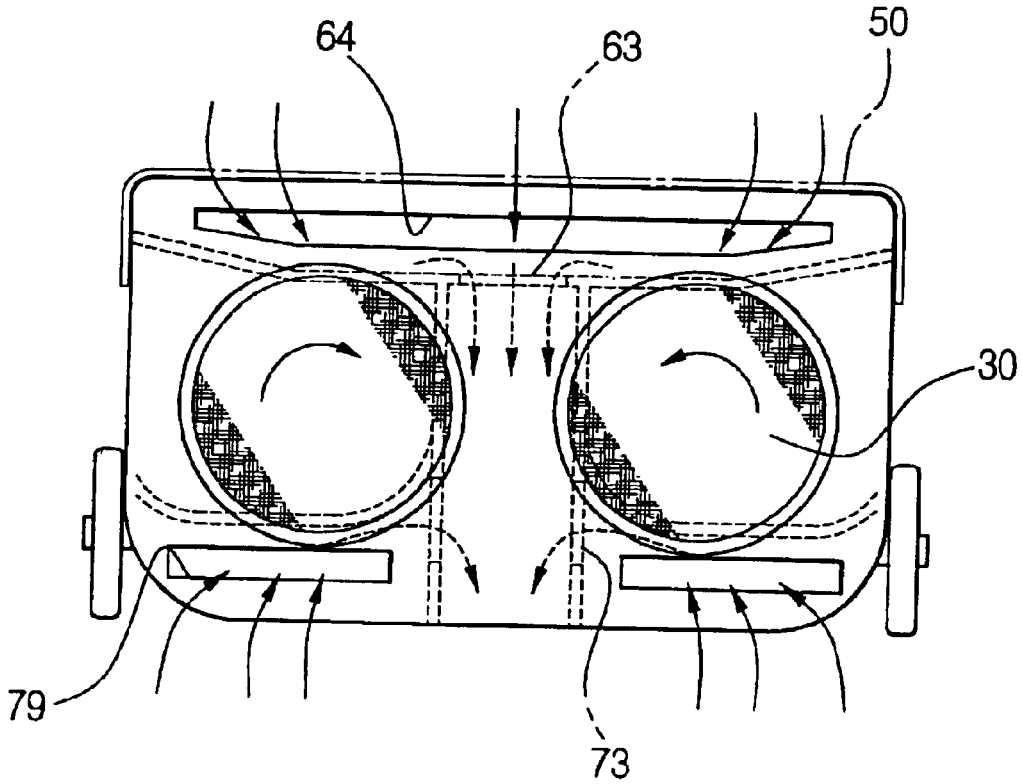
FIG. 7 is a bottom view showing the suction port assembly of FIG. 5.

Referring to FIGS. 5 through 7, suction port assembly 20 according to the third embodiment of the present invention comprises suction port body 21 comprising base 24 and cap 22. The suction port assembly 20 has the same construction as previously described embodiments, and accordingly the suction port assembly 20 includes the suction port body 21 of which a rear portion is joined with an extension hose 7, a pair of floorcloths 30 removably disposed on a bottom of the base 24, and a rotary driving section 40 formed in the suction port body 21 for rotating the pair of floorcloths 30 simultaneously.

Meanwhile, a plurality of rollers 25 are disposed in a rear edge of the suction port body 21 for reducing a friction generated between the bottom of the suction port body 21 and the cleaning surface. The rotary driving section 40 includes bi-directional rotating motor 43 for rotating the floorcloths 30, worm wheel gear 45, and converting gear 47. Further, the rotary driving section 40 may include an extra cover 49 for closing the bi-directional rotating motor 43, the worm wheel gear 45, and the converting gear 47 therein. The converting gear 47 is connected with rotating element 41 disposed on a bottom of the base 24.

The suction port assembly 20 according to the third embodiment includes a first suction path 60 formed at a front portion of the bottom of the base 24, through which the air is drawn, and a pair of second suction paths 70 formed at the rear portion of the base 24 opposite to the first suction path 60 across the rotary driving section 40. Further, a guide path 77 is formed between the first suction path 60 and the second suction paths 70 for guiding the air drawn in through the first suction path 60 and the second suction paths 70 to be discharged out through the extension hose 7. Thus, the second suction paths 70 are formed on the connecting portion between the suction port body 21 and the extension hose 7.

The first suction path 60 is defined by a first barrier 61 of a predetermined height protruding from the bottom of the base 24, and a first cover 62 extended from an end of the first barrier 61 toward a front of the base 24. The first suction path 60 comprises a first suction port 64 of slit type formed at the bottom of the base 24, and a first discharge outlet 63 formed at the barrier 61 and communicating with the guide path 77.

The guide path 77 is defined by a pair of guide barriers 75 protruding from the bottom of the base 24, and an upper portion thereof is closed by a bottom of the cover 49.

Similarly, the second suction paths 70 are defined by a second barrier 71 of a predetermined height protruding from the bottom of the base 24, and a second cover 72 extended from an end of the second barrier 71 toward a rear of the base 24 and the guide barrier 75. The second suction paths 70 comprise a second suction port 79 of slit type formed at the bottom of the base 24, and a second discharge outlet 73 formed at the guide barrier 75 and communicating with the guide path 77.

According to the suction port assembly 20 of the present invention having the construction described above, when a vacuum cleaner operates, a strong suction force is generated by a fan motor (not shown) of a cleaner body, and air containing foreign substances and dust from the cleaning surface are drawn in through the first and the second suction ports 64 and 79, simultaneously. The air and foreign substances flow into the guide path 77 through the first and the second discharge outlets 63 and 73. Then, the air flown into the suction port body 21 is guided by the guide path 77, and discharged into a dust collecting chamber of the cleaner body through the extension hose 7. Simultaneously, the floorcloths 30 mounted on the bottom of the suction port body 21 wipe the stain that is stuck to the cleaning surface, rotating at high speed.

Meanwhile, a user pushes and pulls the suction port assembly 20 forward and backward during the cleaning. At this time, when the user moves the suction port assembly 20 forward, foreign substances and dust are drawn in through the first suction path 60, and do not interfere with the rotation of the floorcloths. When the user moves the suction port assembly 20 backward, foreign substances and dust are drawn in through the second suction paths 70, and also do not interfere with the rotation of the floorcloths.

Since the floorcloths 30 are made of a fiber material that is capable of holding moisture, if necessary, the floorcloths can be used for wet cleaning.

The construction of the suction port assembly 20 having the first and the second suction paths 60 and 70 as described above can be adapted to a general suction port assembly (referring to FIG. 1) without the floorcloths 30 and the rotary driving section 40.

Exactly, if the guide path 77 is closed by an extra closing means instead of the cover 49 of the rotary driving section 40, and communicates with the extension hose 7, the first and the second suction paths 60 and 70 are still formed in a general suction port assembly, and the cleaning efficiency can be enhanced.

Like the previously described embodiments, the suction port assembly 20 according to the third embodiment may further comprise an elastic member 50 disposed on a front edge thereof for preventing from the collision with an obstacle while being moved along the cleaning surface. A floorcloth cover 22*d* may also be provided in a consideration of the user's safety from the rotating floorcloths 30.

According to the suction port assembly 20 of the vacuum cleaner of the present invention as described above, the suction port assembly 20 is prevented from shock of the collision with an external obstacle by the elastic member disposed thereon for buffering a shock. Accordingly, since the user can move the suction port assembly 20 as he/she wishes, cleaning becomes easy. Also, since the suction port assembly 20 is prevented from damage and defect, the life span of the cleaner can be extended.

Another advantage of the suction port assembly 20 is the safety from the floorcloths rotating at high,speed and enhanced cleaning efficiency through a guidance of foreign substances wiped by the floorcloths 30 into the suction path 64 and 79.

Meanwhile, while the suction port assembly 20 moves along cleaning surface forward and backward, since dirt from the cleaning surface is drawn in through the first and second suction paths 60 and 70 formed at the front and the rear portions of the suction port assembly 20, that is, since dirt is drawn in two directions to the front and the rear portions of the suction port body 21 for the cleaning, the cleaning efficiency is enhanced.

In case that the floorcloths 30 are rotatably disposed on the lower portion of the suction port assembly 20, since foreign substances and dust do not interfere with the rotation of the floorcloths when the suction port assembly 20 moves along cleaning surface forward and backward, the stable operation of the floorcloths and a reduced load of the rotary driving section 40 for the floorcloths 30 are can be guaranteed. Although a few preferred embodiments of the present invention have been shown and described, it will be appreciated by those skilled in the art that changes may be made in these embodiments without departing from the principles and spirit of the invention, scope of which is defined in the claims and their equivalents.

What is claimed is:

1. A suction port assembly of a vacuum cleaner including:

a suction port body having a suction port for drawing in air containing dust and foreign substances from a cleaning surface therethrough by a suction force generated when a driving motor is driven;

a floorcloth rotatably disposed on a bottom of the suction port body, adjacent to the suction port, for wiping foreign substances that are stuck to the cleaning surface;

a rotary driving section formed inside the suction port body for rotating the floorcloth;

a floorcloth cover formed in the suction port body for covering a side edge of the floorcloth so as to prevent the side edge of the floorcloth contacted with the cleaning surface from being exposed from the suction port body;

a first suction path formed at a front portion of a bottom of the suction port body, through which air containing dust is drawn in from the suction port;

a second suction path formed at a rear portion of a bottom of the suction port body, through which air containing dust is drawn in from a rear portion of the suction port body; and a guide path which extends between the first suction path and the second suction path for guiding the air that is drawn in through the first suction path and the second suction path to be discharged out through an extension hose coupled to the suction port body;

wherein the first suction path and the second suction path are formed at the front and the rear portion of the bottom of the suction port body with respect to the rotary driving section, respectively, and a top of the guide path is closed, by the rotary driving section.

2. The suction port assembly of claim 1, wherein the floorcloth cover comprises:

a floorcloth cap extended from the bottom of the suction port body for covering an upper surface of the top of the floorcloth facing the bottom of the suction port body, having a circular arc shaped edge corresponding to the profile of the side edge of the floorcloth; and a fence extended from the circular arc shaped edge toward the cleaning surface for covering the side edge of the floorcloth.

3. The suction port assembly of claim 1, further including shock-buffering means arranged along the front portion of the suction port body for reducing a shock when the suction port body collides with an obstacle while moving along the cleaning surface.

4. The suction port assembly of claim 2, wherein the second suction path includes a second suction port formed at the bottom of the suction port body, and a discharge outlet formed at a sidewall of the guide path.

5. The suction port assembly of claim 4, wherein the second suction path includes a pair of suction paths formed at opposed side portions of the suction body with respect to a connecting portion between the suction port assembly and the extension hose, respectively.

* * * * *

UNITED STATES PATENT AND TRADEMARK OFFICE

CERTIFICATE OF CORRECTION

PATENT NO. : 6,842,941 B2
DATED : January 18, 2005
INVENTOR(S) : Byung-jo Lee

It is certified that error appears in the above-identified patent and that said Letters Patent is hereby corrected as shown below:

Column 8,
Line 34, delete "claim 2" and insert -- claim 1 --.

Signed and Sealed this

Third Day of May, 2005

JON W. DUDAS
*Director of the United States Patent and Trademark Office*